US006349917B1

(12) United States Patent
Gunter et al.

(10) Patent No.: US 6,349,917 B1
(45) Date of Patent: Feb. 26, 2002

(54) METHOD AND APPARATUS FOR SUPPORTING AN ELONGATE STRUCTURE

(76) Inventors: Coke S. Gunter, 26 11$^{TH}$ Ave. NE.; George McGinness, 341 5$^{TH}$ Ave. Pl. NE., both of Hickory, NC (US) 28601; Kathryn C. Brondyke, 2601 Timber Trail, Asheville, NC (US) 28804

( * ) Notice: Subject to any disclaimer, the term of this patent is extended or adjusted under 35 U.S.C. 154(b) by 0 days.

(21) Appl. No.: 09/404,521

(22) Filed: Sep. 23, 1999

(51) Int. Cl.$^{7}$ ..... F16M 13/00

(52) U.S. Cl. ..... 248/519; 248/523; 248/524; 47/40.5

(58) Field of Search ..... 248/519, 523, 248/524; 47/40.5, 39, 23, 24, 44, 42

(56) References Cited

U.S. PATENT DOCUMENTS

| | | | | | |
|---|---|---|---|---|---|
| 3,227,405 | A | | 1/1966 | Layton | |
| 3,353,773 | A | | 11/1967 | Budd | |
| 3,405,896 | A | * | 10/1968 | Eby | 248/44 |
| 3,480,241 | A | | 11/1969 | Moyer | |
| 3,622,036 | A | | 11/1971 | Bongaerts | |
| D248,804 | S | | 8/1978 | Budd | |
| 4,190,983 | A | * | 3/1980 | Rostomily | 47/40.5 |
| 4,318,246 | A | * | 3/1982 | Jungbluth et al. | 47/42 |
| 4,429,846 | A | * | 2/1984 | Halvorson | 248/524 |
| 4,894,950 | A | * | 1/1990 | Yukio et al. | 47/42 |
| D308,028 | S | | 5/1990 | Moriarty | |
| D310,500 | S | | 9/1990 | Matousek | |
| 5,228,657 | A | * | 7/1993 | Hall | 248/230 |
| D349,259 | S | | 8/1994 | Adam | |
| 5,368,281 | A | | 11/1994 | Skyba | |
| D361,504 | S | * | 8/1995 | Wollar | D8/373 |
| 5,791,626 | A | | 8/1998 | Reese | |
| 5,842,676 | A | | 12/1998 | Plzak | |

* cited by examiner

*Primary Examiner*—Anita King
*Assistant Examiner*—Kimberly Wood
(74) *Attorney, Agent, or Firm*—Adams, Schwartz & Evans, P.A.

(57) ABSTRACT

A stand for supporting an elongate upright structure, including a base having a substantially larger perimeter that the structure to be supported, a plurality of support cables attached to the base at spaced-apart intervals along the perimeter thereof for being extended upwardly and inwardly towards the structure being supported, each of the support cables carrying an attachment hook thereon. The stand also includes a collar for being releasably and adjustably secured along the perimeter of the structure, and an attachment means complementary with the hooks for receiving the hooks and thereby maintaining the support cables in a tensioned condition between the base and the collar, the attachment means being adjustable in relation to the collar for alignment with the cables.

12 Claims, 4 Drawing Sheets

METHOD AND APPARATUS FOR SUPPORTING AN ELONGATE STRUCTURE

TECHNICAL FIELD AND BACKGROUND OF INVENTION

This invention relates to a method and apparatus for supporting an elongate structure such as a cut tree, a flagpole, a piling, or any other elongate structure that must be erected and maintained in an upright position. For purposes of illustration the particular embodiment disclosed in this application is intended for use with a cut tree, such as a Christmas tree.

To hold a tree in place, some prior art tree stands utilize a plurality of adjustable screws or clamps near the base of the tree that, in some instances, works in combination with a collar mounted onto and above a base in which the tree stands. Other prior art tree stands hold a tree stationary by utilizing support cables that extend upward from the base of the stand and attach to the limbs.

U.S. Pat. No. 3,353,773 and U.S. Pat. No. Des. 248,804, both expired, disclose tree stands that use a support cable and hook assembly arrangement. U.S. Pat. No. 3,353,773 discloses the hooks on the support cables being hooked into links on a chain wrapped around the trunk of the tree. However, the chain has disadvantages; attaching support cable hooks to links in the chain is difficult because the chain links are necessarily in close proximity to the tree trunk, some likely resting flush against the tree trunk, rendering them inaccessible by hooks. In addition, adjusting the length of chain engaging the tree is difficult because of the close proximity of the chain to the tree trunk as well as the bulk of the chain. Thirdly, the smallest increment of chain length adjustment is the length of a single chain link, making exact, precise chain length adjustments impossible and likely ultimately requiring the user to select a chain length that leaves the chain hanging loosely around the tree, thereby compromising tree stability. Finally, the chain is likely to damage the tree trunk.

The present invention overcomes these problems by providing for the support cables to hook onto rings suspended from an adjustable collar wrapped around the tree trunk. The rings are suspended from a plurality of loops encircling the collar, making the rings easily accessible by the support cables. The loops may slide along the collar strap to allow for adjustment of the rings along the perimeter of the tree, thereby avoiding tree limbs. The two ends of the collar are threaded through complementary male and female halves of a releasable connector, thereby allowing the length of the collar to be adjusted in very small increments of adjustment and ensuring that the collar remains tight and secure around the tree without causing tree damage. In a preferred embodiment of the invention, the collar and the loops are composed of woven tape or webbing. In general, the construction of the collar allows for easy connection of the support cables and easy and secure adjustment of the collar, all while minimizing tree damage.

A preferred embodiment of the present invention incorporates the water receptacle base of the tree stand shown in U.S. Pat. No. Des. 248,804. The base includes holes through which the support cables are threaded before being secured to the base by being knotted against the underside of the base.

Prior art tree stands employing support cables provide for adjusting the length of the support cables by raising and lowering handles attached to the cables. In such assemblies, the support cables frequently engage their respective hooks merely by threading through eyes at the bases of the hooks. Such handle mechanisms can be bulky and awkward to operate and they result in inexact cable adjustment as well as an increased likelihood of cable slippage. In contrast, the hooks in the present invention engage ratchets through which the support cables travel. The support cables are merely pulled through the ratchets until the cables reach the desired length. The ratchets prevent the inadvertent loosening of the support cable portions between the base and the ratchets, while allowing the user to adjust the length of those portions by either pulling more cable through the ratchets if the cable is not tight enough or by depressing spring-loaded release levers on the ratchets if the cable is too tight. Therefore, use of the ratchets obviates the need for handles and allows for more precise and secure orientation of the tree. A preferred embodiment of the ratchets is described in U.S. Pat. Nos. 5,368,281 and 5,722,640, both issued to Skyba.

SUMMARY OF THE INVENTION

Therefore, it is an object of the invention to provide a method and apparatus for supporting an elongate structure such as a cut tree.

It is another object of the invention to provide a method and apparatus for supporting an elongate structure that allows for secure orientation of the elongate structure in an upright position.

It is another object of the invention to provide a method and apparatus for supporting an elongate structure that allows the user to attach the apparatus to the structure while the structure is either horizontally or vertically oriented.

It is another object of the invention to provide an apparatus for supporting an elongate structure that includes a structure-engaging collar allowing for easy attachment of accompanying support cables.

It is another object of the invention to provide an apparatus for supporting an elongate structure that includes a structure-engaging collar that may be adjusted in length in an easy, fluid manner.

It is another object of the invention to provide an apparatus for supporting an elongate structure that includes a structure-engaging collar that minimizes damage to the structure.

It is another object of the invention to provide an apparatus that includes support cables that may be adjusted and secured with minimal slippage.

It is another object of the invention to provide an apparatus that includes a structure-engaging collar that allows for easy adjustment of the support cables along the collar.

These and other objects of the present invention are achieved in the preferred embodiments disclosed below by providing a stand for supporting an elongate upright structure. The stand includes a base having a substantially larger perimeter that the structure to be supported, a plurality of support cables attached to the base at spaced-apart intervals along the perimeter thereof for being extended upwardly and inwardly towards the structure being supported, each of the support cables carrying an attachment hook thereon. The stand also includes a collar for being releasably and adjustably secured along the perimeter of the stricture, and an attachment means complementary with the hooks for receiving the hooks and thereby maintaining the support cables in a tensioned condition between the base and the collar, the attachment means being adjustable in relation to the collar for alignment with the cables.

According to one preferred embodiment of the invention, the collar is adjustable in length to conform to the perimeter of the structure.

According to another preferred embodiment of the invention, the collar is fabricated of woven tape.

According to yet another preferred embodiment of the invention, the attachment means includes slidable loops encircling the collar and a plurality of downwardly-extending rings suspended from the loops.

According to yet another preferred embodiment of the invention, the loops are fabricated of woven tape.

According to yet another preferred embodiment of the invention, the collar comprises a releasable snap connector for securing the collar around the perimeter of the structure and for removing the collar from the perimeter of the structure.

According to yet another preferred embodiment of the invention, the structure is a cut tree.

According to yet another preferred embodiment of the invention, the base includes a upwardly-projecting stabilizing means for penetrating the cut end of the tree.

According to yet another preferred embodiment of the invention, the stabilizing means includes teeth.

According to yet another preferred embodiment of the invention, the stabilizing means includes spikes.

According to yet another preferred embodiment of the invention, the base comprises a water receptacle.

An embodiment of a method according to the invention for erecting and supporting an elongate structure with a stand, the stand including a base, a plurality of support cables each carrying an attachment hook, and a collar from which rings are suspended. The method includes the steps of positioning the structure horizontally, placing the collar around the structure at a point located approximately one-quarter of the structure's length from an end of the structure, and spacing the rings suspended from the collar and positioned adjacent to one another at approximately equal distances from one another. The method further includes the steps of securing the collar around the perimeter of the structure, setting the structure in an upright position onto the base of the stand, attaching the hooks to the rings suspended from the collar, adjusting the support cables one-by-one to straighten the structure into a desired position, and tightening the support cables to secure the structure in the desired position.

Another embodiment of a method according to the invention for erecting and supporting an elongate structure with a stand, the stand including a base, a plurality of support cables each carrying an attachment hook, and a collar from which rings are suspended. The method includes the steps of positioning the structure horizontally, placing the collar around the structure at a point located approximately one-quarter of the structure's length from an end of the structure, and spacing the rings suspended from the collar and positioned adjacent to one another at approximately equal distances from one another. The method further includes the steps of securing the collar around the perimeter of the structure, setting the horizontally-positioned structure onto the base of the stand, attaching the hooks to the rings suspended from the collar, and uprighting the structure as it rests on the base of the stand. The method further includes the steps of adjusting the support cables one-by-one to straighten the structure in to a desired position and tightening the support cables to secure the structure in the desired position.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
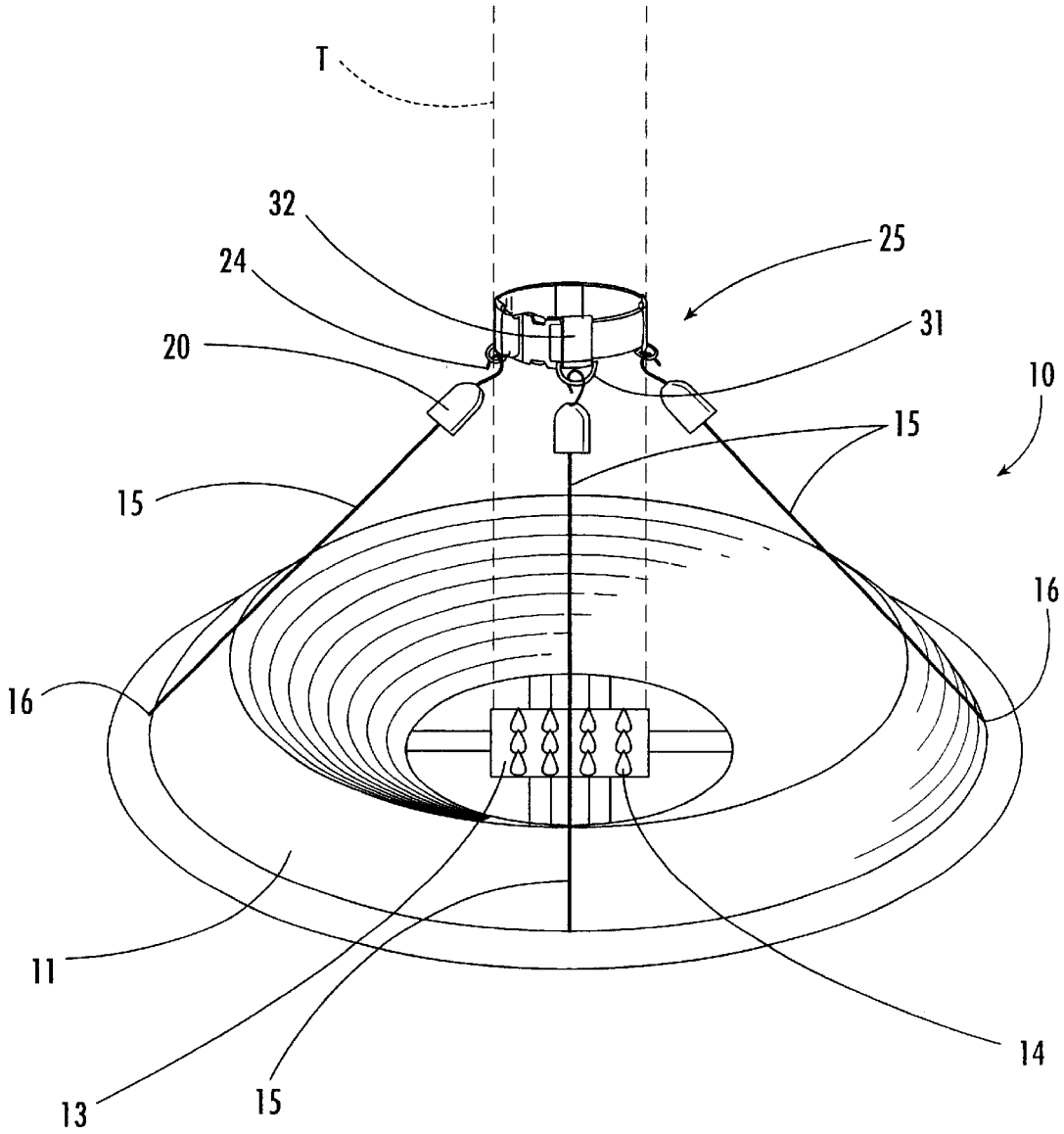
FIG. 1 is a perspective view of a tree stand according to a preferred embodiment of the invention as it appears when in use, with the tree indicated by dotted lines.
Figure 2:
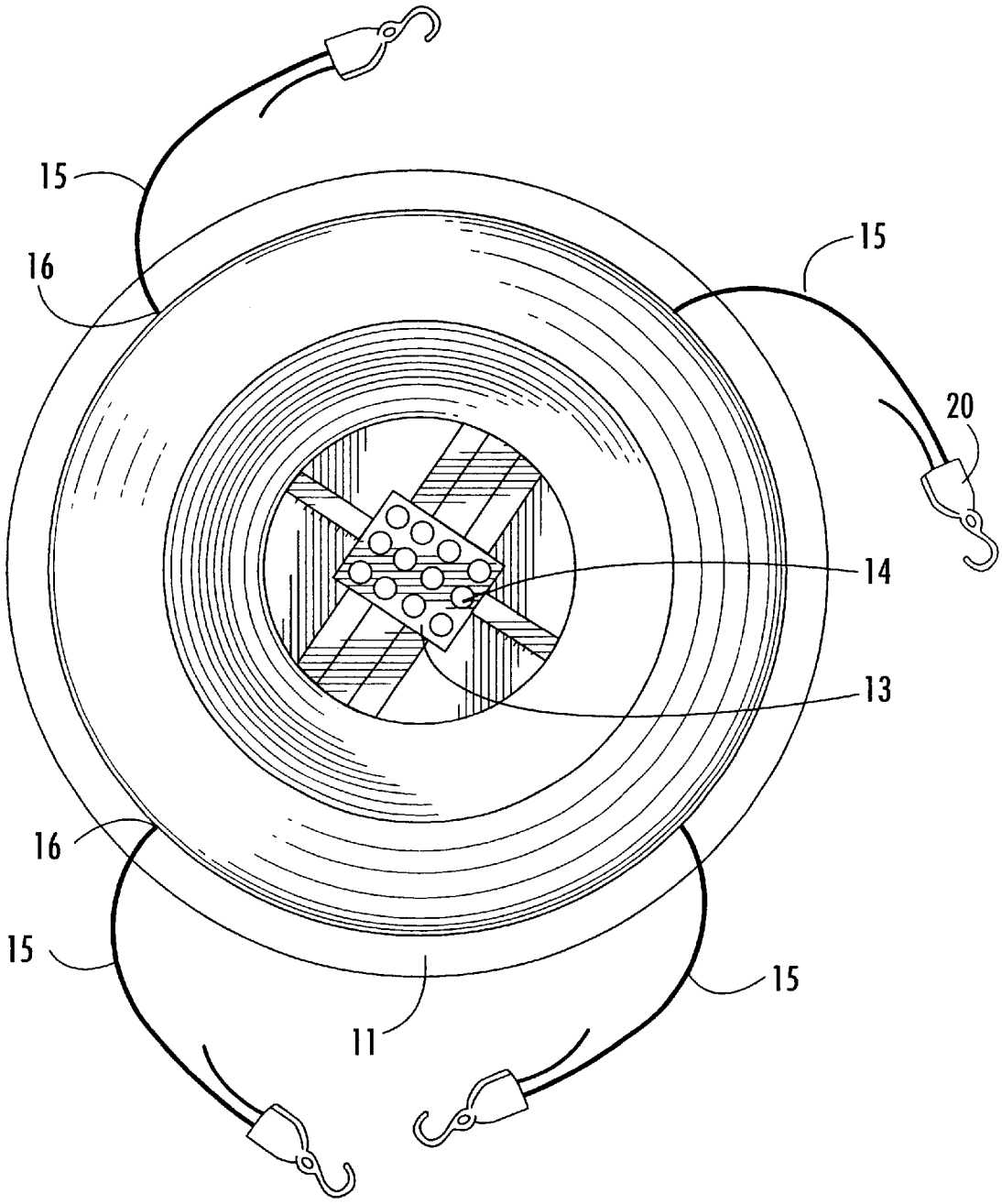
FIG. 2 is a top plan view of the base and cable portion of a tree stand according to a preferred embodiment of the invention.

Referring now specifically to the drawings, a stand for supporting an elongate structure according to the present invention is illustrated in FIG. 1 and shown generally at reference numeral 10. In a preferred embodiment, the stand 10 is designed to support a cut tree "T" in an upright position. The stand 10 includes a base 11 which comprises a plastic water receptacle 1I having a perimeter larger than that of the cut end of the cut tree "T." Affixed to the bottom of the receptacle 11 by rivets, screws, adhesive, or other fastening means is a metal plate 13 bearing an upwardly-projecting stabilizing means such as metal teeth or spikes 14 for penetrating the cut end of the cut tree 12. FIG. 2 illustrates the receptacle 11, metal plate 13, and spikes 14 of the stand 10 more clearly as they appear when they are not in use.

Referring again to FIG. 1, a plurality of support cables 15 is attached to the receptacle 11. Such attachment may be achieved by boring holes 16 in the receptacle 11 for carrying the cables 15, threading the cables 15 through the holes 16, and knotting the receptacle ends of the cables 15 to prevent the cables 15 from being pulled back through the holes 16. The cables 15 may also be attached to the receptacle 11 using rivets, screws, or adhesive (not shown). The ends of the support cables 15 opposite those attached to the receptacle 11 are each threaded and pulled through a ratchet 20 to the desired length to the support the tree 12. The ratchets 20 allow the length of the portions of the cables 15 between the receptacle 11 and the ratchets 20 to be easily and precisely adjusted without slippage. FIG. 2 illustrates the cables 15, holes 16, and ratchets 20 of the stand 10 more clearly as they appear when they are not in use.

Figure 4:
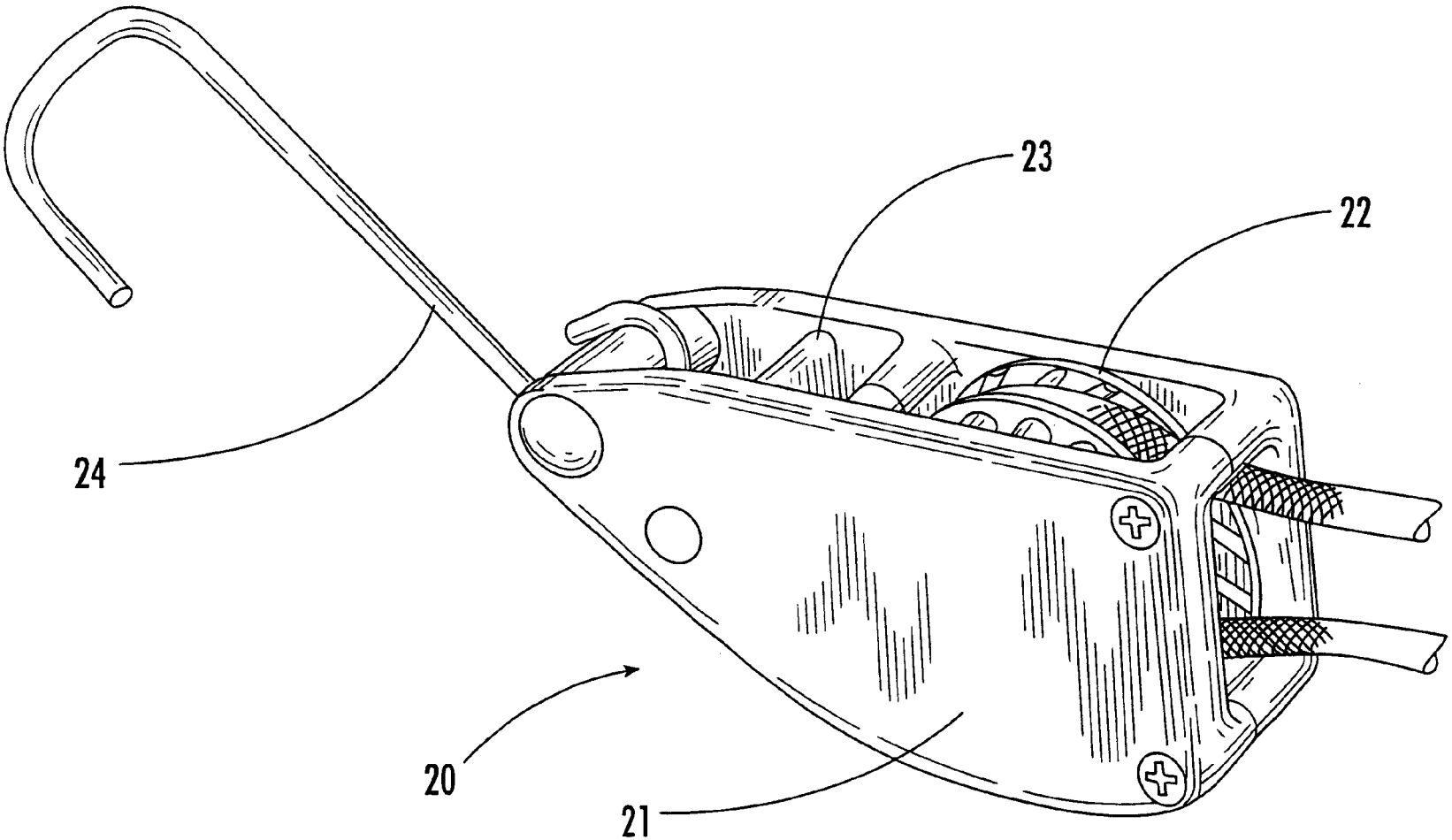
FIG. 4 is a perspective view of the ratchet that carries the support cables according to a preferred embodiment of the tree stand, as well as the attached hooks that, when in use, engage the collar of a preferred embodiment of the tree stand.

In the preferred embodiment, the ratchets 20 utilized are those rated for a maximum load of seventy-five pounds that are marketed and manufactured under the name ROPE RATCHET® by Carolina North Manufacturing of Kernersville, N.C. FIG. 4 shows the ratchet 20 in detail. The ratchet 20, which is disclosed in U.S. Pat. Nos. 5,368,281 and 5,722,640, both issued to Skyba, includes a housing 21 in which resides a toothed ratchet wheel 22 and a spring-loaded lever 23 for moving a tooth-engaging member (not shown) to and from teeth (not shown) on the ratchet wheel 22, thereby locking and releasing the ratchet 20 as needed.

Figure 3:
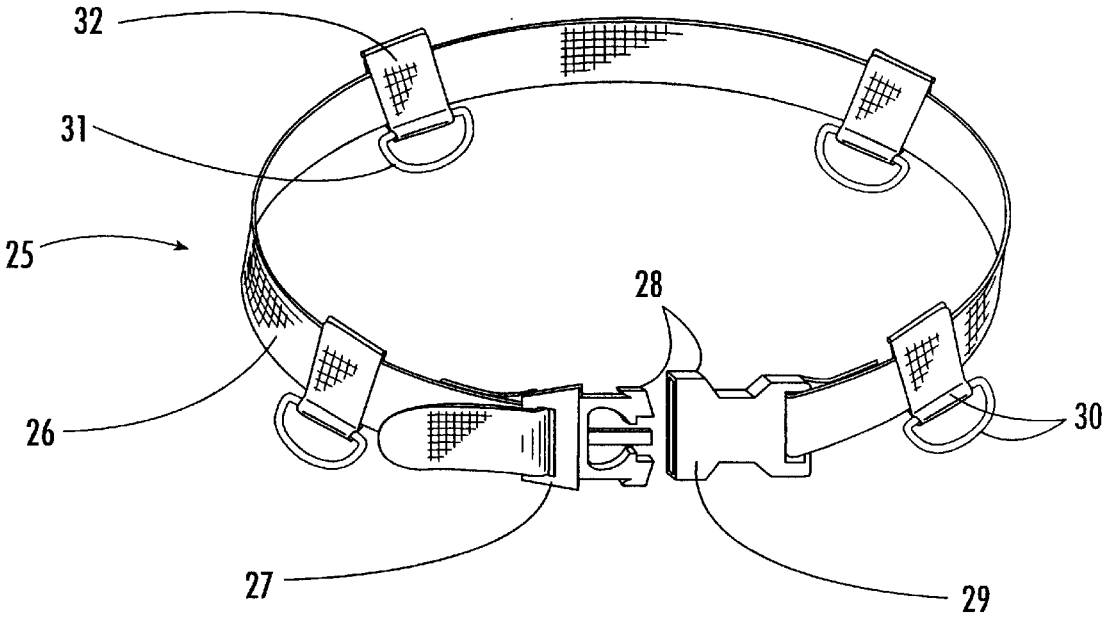
FIG. 3 is a perspective view of the collar of a preferred embodiment of the tree stand.

The ratchet 20 also carries a hook 24. When the stand 10 is in use, as shown in FIG. 1, the hooks 24 on the ratchets 20 engage a collar 25 that wraps around the tree 12. FIG. 3 shows the collar 25 in detail. The collar 25 includes an elongate collar strap 26 of woven tape, webbing, or other flexible material. One end of the strap 26 is adjustably threaded through the male component 27 of a two-piece releasable snap connector 28 while the other end of the strap 26 is attached to the female component 29 of the connector 28. The connector 28 allows for adjustment of the length of the portion of the strap 26 that contacts the tree 12. The strap 26 also carries attachment means 30 for attaching the hooks 24 (FIG. 1) to the collar 25. The attachment means 30 comprises a plurality of rings 31, each of which is suspended from a loop 32 encircling the strap 26. In a preferred embodiment, four loops 32 fabricated of the same material as the strap 26 encircle the strap 26. The rings 31 are metal "D"-shaped rings. The loops 32 may be slid along the strap 26 to position the rings 24 as desired. As shown in FIG. 1, the loops 32 and rings 31 allow the user to attach the hooks 24 to the collar 25 easily and effectively without the difficulties associated with hooking cables to chain collars.

The invention may be utilized to erect and support a tree according to the following method. First, the tree "T" is horizontally positioned. The collar 25 is then loosely wrapped around the tree "T" at a point located approximately one-quarter of the tree's length from the cut end of the tree "T." The strap 26 is adjusted until it reaches the proper length to engage the perimeter of the tree "T" snugly. The loops 32 on the collar 25 are then spaced equal distances from one another. Next, the connector members 27 and 29 are connected. The tree "T" is then turned upright into the receptacle 11 such that the cut end of the tree "T" is penetrated by the spikes 14 on the metal plate 13 mounted in the receptacle 11. The hooks 24 carried by the ratchets 20 are then attached to the rings 31 suspended from the loops 32 encircling the collar 25. Next, the support cables 15 are pulled one-by-one through their respective ratchets 20 until the cable portions between the receptacle 11 and the ratchets 20 are taut, thereby securing the tree "T" in an upright position. Adjustments may be made in the position of the cables 15 as needed.

In another preferred method of utilizing the invention, the tree "T" remains in a horizontal position until after the hooks 24 are attached to the rings 31 on the collar 25, at which time the tree "T" is turned upright.

A method and apparatus for supporting an elongate structure is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. A stand for supporting an elongate upright structure, comprising:

(a) a base;

(b) a plurality of support cables attached to said base at spaced-apart intervals along the perimeter thereof for being extended upwardly and inwardly towards the structure being supported, each of said support cables carrying an attachment hook thereon;

(c) a collar for being releasably and adjustably secured around the perimeter of the structure, comprising a releasable snap connector for securing said collar around the perimeter of the structure and for removing the collar from the perimeter of the structure; and (d) attachment means complementary with the hooks for receiving the hooks and thereby maintaining the support cables in a tensioned condition between the base and the collar, said attachment means being adjustable in relation to the collar for alignment with the cables.

2. A stand according to claim 1, wherein said collar is adjustable in length to conform to the perimeter of the structure.

3. A stand according to claim 1, wherein said collar is fabricated of woven tape.

4. A stand according to claim 1, wherein said attachment means comprises slidable loops encircling said collar and a plurality of downwardly-extending rings suspended from said loops.

5. A stand according to claim 4, wherein said loops are fabricated of woven tape.

6. A stand according to claim 1, wherein the structure is a cut tree.

7. A stand according to claim 6, wherein said base comprises a upwardly-projecting stabilizing means for penetrating the cut end of the tree.

8. A stand according to claim 7, wherein said stabilizing means comprises teeth.

9. A stand according to claim 7, wherein said stabilizing means comprises spikes.

10. A stand according to claim 1, wherein said base comprises a water receptacle.

11. A method for erecting and supporting an elongate structure with a stand, the stand including a base, a plurality of support cables each carrying an attachment hook, and a collar from which rings are suspended, said collar including a releasable snap connector for securing the collar around the perimeter of the structure and for removing the collar from the perimeter of the structure, said method comprising the steps of:

(a) positioning the structure horizontally;

(b) placing the collar around the structure at a point located approximately one-quarter of the structure's length from an end of the structure;

(c) spacing the rings suspended from the collar and positioned adjacent to one another at approximately equal distances from one another;

(d) securing the collar around the perimeter of the structure;

(e) setting the structure in an upright position onto the base of the stand;

(f) attaching the hooks to the rings suspended from the collar;

(g) adjusting the support cables one-by-one to straighten the structure into a desired position; and (h) tightening the support cables to secure the structure in the desired position.

12. A method for erecting and supporting an elongate structure with a stand, the stand including a base, a plurality of support cables each carrying an attachment hook, and a collar from which rings are suspended, said collar including a releasable snap connector for securing the collar around the perimeter of the structure and for removing the collar from the perimeter of the structure, said method comprising the steps of:

(a) positioning the structure horizontally;

(b) placing the collar around the structure at a point located approximately one-quarter of the structure's length from an end of the structure;

(c) spacing the rings suspended from the collar and positioned adjacent to one another at approximately equal distances from one another;

(d) securing the collar around the perimeter of the structure;

(e) setting the horizontally-positioned structure onto the base of the stand;

(f) attaching the hooks to the rings suspended from the collar;

(g) uprighting the structure as it rests on the base of the stand;

(h) adjusting the support cables one-by-one to straighten the structure into a desired position; and (i) tightening the support cables to secure the structure in the desired position.

* * * * *